United States Patent [19]

Leivestad

[11] Patent Number: 4,538,705

[45] Date of Patent: Sep. 3, 1985

[54] METHOD AND APPARATUS FOR MOVING A PLATFORM INTO A SUSPENDED OUTBOARD POSITION

[75] Inventor: Ole E. Leivestad, Renton, Wash.

[73] Assignee: Spider Staging, Inc., Renton, Wash.

[21] Appl. No.: 587,216

[22] Filed: Mar. 7, 1984

[51] Int. Cl.[3] ..... E04G 3/10

[52] U.S. Cl. ..... 182/142

[58] Field of Search ..... 182/142, 143, 150, 36, 182/37

[56] References Cited

U.S. PATENT DOCUMENTS 876,194 1/1908 Kersey ..... 182/37

3,302,750 2/1967 Arnold ..... 182/142

*Primary Examiner*—Reinaldo P. Machado

*Attorney, Agent, or Firm*—Delbert J. Barnard

[57] ABSTRACT

A pair of stanchions (12) is mounted on a roof (4) for rotation about spaced apart vertical axes (18). Each end of an elongated platform (22) is connected to an upper horizontal portion (16) of one of the stanchions (12). Platform (22) is raised by winches (24). Workers ($W_1$, $W_2$) positioned on platform (22) push and pull on horizontal portions (16) to rotate stanchions (12 ) and move platform (22) into a suspended position outboard of the structure (2). Each horizontal portion (16) is provided with an outwardly extending lever (34) having a pull line (32) at its outer end. Workers ($W_1$, $W_2$) use levers (34) and pull lines (32) to assist in rotating stanchions (12). Workers ($W_1$, $W_2$) alternate pushing and pulling on the horizontal portions (16) of their respective stanchions (12).

9 Claims, 11 Drawing Figures

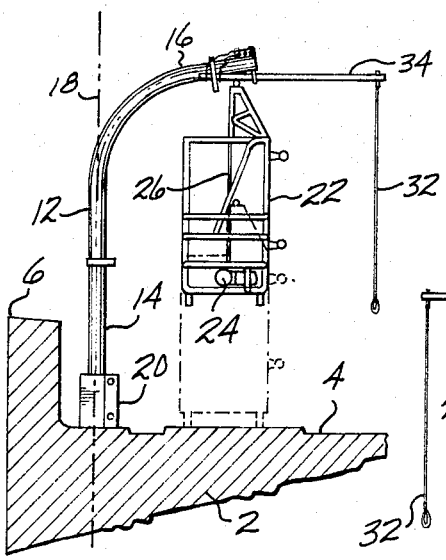
Fig. 1
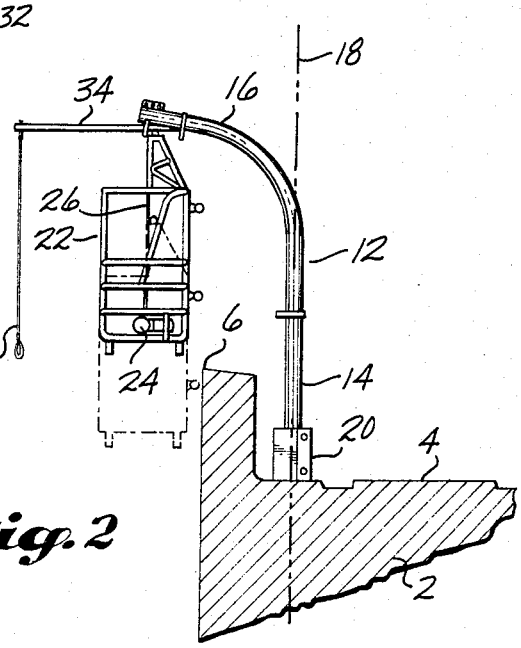
Fig. 2
Fig. 3
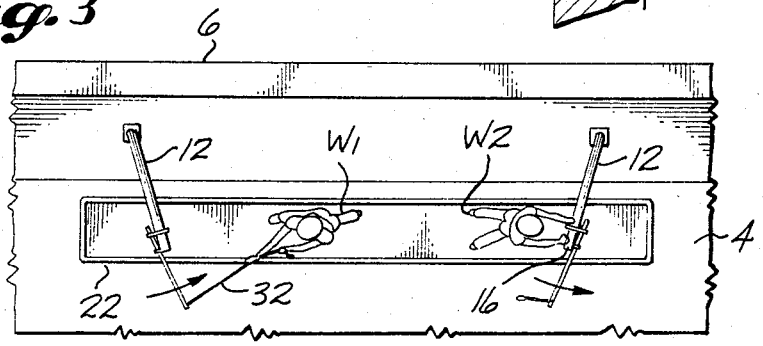
Fig. 4
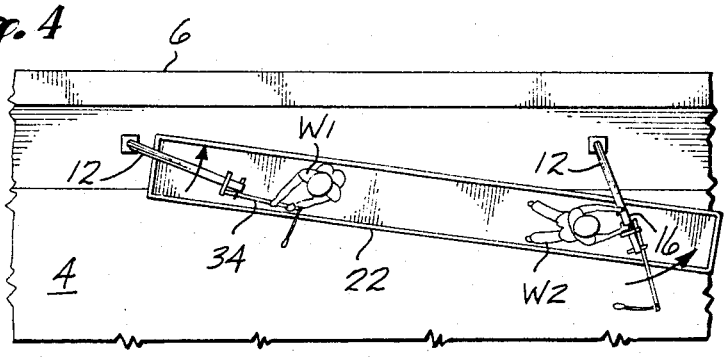

METHOD AND APPARATUS FOR MOVING A PLATFORM INTO A SUSPENDED OUTBOARD POSITION

DESCRIPTION

TECHNICAL FIELD

This invention relates to methods and apparatus for moving a platform suspended from stanchions over a roof structure into a position in which it is suspended outboardly of the structure and, more particularly, to such a method and apparatus in which workers positioned on the platform push and pull on the stanchions to turn the stanchions and thereby move the platform.

BACKGROUND ART

There are many situations in which there is a need to perform work on the sides of a high structure and in which access to such sides must be obtained by lowering a suspended platform over the edge of a top or roof portion of the structure. The lowering of the platform brings workers located on the platform into position to perform the necessary work. A problem connected with this procedure is that using known methods and apparatus for moving the platform into position to be lowered down the side of the structure requires extra workers in addition to the workers located on the platform. The extra workers perform the operation of moving the platform from a position over the top of the structure to a position outboard of the structure. In order to safely move the platform, known methods involve the positioning of a first crew of workers on the platform which is resting on the top of the structure, the raising of the platform into a position in which it is suspended from a pair of stanchions above the top of the structure, and then the moving of the platform by a second screw of workers into a position in which it is suspended from the stanchions outwardly of the side edge of the top of the structure. The second crew usually moves the platform by pushing and pulling on the platform or on the platform and the stanchions.

Once this operation has been performed, the necessary lowering of the platform may be accomplished by the first crew of workers positioned on the platform. The second extra crew of workers has nothing further to do until such time as the platform is raised and moved back into position over the top of the structure at the completion of the task or the end of the work day. Therefore, a good deal of work time is spent inefficiently by the second crew in either waiting for the first crew to complete their task or moving back and forth between the top of the structure and other work sites. This waste of work time can be a serious economic disadvantage.

DISCLOSURE OF THE INVENTION

The present invention is directed toward solving the problem discussed above of inefficient use of the time of workers. Therefore, the method and apparatus of the present invention provide means by which a single crew of workers located on a platform can themselves move the platform into position to be lowered down the side of a structure so that no additional workers are necessary.

A subject of the invention is a method of moving a platform from a position on a roof of a structure to a suspended position outboard of the structure. According to as aspect of the invention, the method comprises providing a pair of stanchions, each of a type having a vertical portion and an upper horizontal portion. The stanchions are mounted at spaced apart locations on the roof of the structure, for rotation about axes coinciding with said vertical portions, between an inboard position in which the horizontal portions of the stanchions project inwardly over the roof of the structure and an outboard position in which the horizontal portions of the stanchions project outwardly from the structure. An elongated platform is positioned on the roof of the structure, with each stanchion in its inboard position, with a first end of the platform located under the horizontal portion of a first one of the stanchions, and with the second end of the platform located under the horizontal portion of the second stanchion. The first end of the platform is connected to the first stanchion by a first suspension system. This system includes an upper end that is attached to the horizontal portion of the first stanchion and a lower end that is attached to the platform. The second end of the platform is connected to the second stanchion by a second suspension system. This second system includes an upper end that is attached to the horizontal portion of the second stanchion and a lower end that is attached to the platform. Each of the systems includes a winch drum which, when rotated in one direction, causes the platform to move upwardly, and when rotated in the opposite direction, causes the platform to move downwardly. Two workers are located on the platform, one at each end of the platform. The suspension systems are operated to raise the platform up off of the roof into a position from which the platform can be moved into its outboard position by rotation of the stanchions. The elevated platform is moved into its outboard position in the following manner. One of the workers pulls on the horizontal portion of the first stanchion while the second worker pushes on the horizontal portion of the second stanchion, until the horizontal portion of the first stanchion is generally aligned with the platform. Then the first worker pushes on the horizontal portion of the first stanchion while the second worker pulls on the horizontal portion of the second stanchion, until the first end of the platform is located outboardly of the structure and the first stanchion is generally in its outboard position. Then the first worker again pulls on the horizontal portion of the first stanchion while the second worker again pushes on the horizontal portion of the second stanchion, until the stanchions are in their outboard positions and the platform is in an outboard position generally parallel to the face of the structure.

According to another aspect of the method of the invention, the method comprises providing the horizontal portion of each stanchion with a pull line. The workers use the pull lines at least part of the time while pulling on the stanchions. According to still another aspect of the method of the invention, the method comprises providing each stanchion with a lever which projects endwise outwardly from the horizontal portion of the stanchion, and securing the pull line to the outer end of the lever.

Another subject of the invention is suspended platform apparatus. According to an aspect of the invention, the apparatus comprises a pair of stanchions, each of a type having a vertical portion and an upper horizontal portion. The apparatus has means for mounting the stanchions at spaced apart locations on a roof of a structure, for rotation about axes coinciding with said vertical portions, between an inboard position in which the horizontal portions of the stanchions project inwardly over the roof of the structure and an outboard position in which the horizontal portions of the stanchions project outwardly from the structure. The apparatus also includes an elongated platform having a first end and a second end. The platform is of such a length that, when the two stanchions are in their inboard positions and the platform is on the roof below the horizontal portions of the two stanchions, the first end of the platform is located under the horizontal portion of a first one of the stanchions and the second end of the platform is located under the horizontal portion of the second stanchion. A first suspension system connects the first end of the platform to the first stanchion. This system includes an upper end attached to the horizontal portion of the first stanchion and a lower end attached to the first end of the platform. The system also includes a winch drum which, when rotated in one direction, causes the platform to move upwardly, and when rotated in the opposite direction, causes the platform to move downwardly. A second suspension system connects the second end of the platform to the second stanchion. This second system includes an upper end attached to the horizontal portion of the second stanchion and a lower end attached to the second end of the platform. The second system also includes a winch drum which, when rotated in one direction, causes the platform to move upwardly, and when rotated in the opposite direction, causes the platform to move downwardly. The apparatus has means for rotating the stanchions by two workers located on the platform, one adjacent to each stanchion. This means for rotating includes a pull line attached to the horizontal portion of each stanchion, operable by a worker who is positioned adjacent to such stanchion to pull on the horizontal portion of such stanchion while the other worker is pushing on the horizontal portion of the other stanchion.

According to another aspect of the invention, the apparatus comprises a lever carried by each stanchion. Each such lever is attached to the horizontal portion of its stanchion and projects endwise outwardly beyond the outer end of the horizontal portion of the stanchion a predetermined distance. The pull lines are attached to the outer ends of the levers. The predetermined distance is sufficiently great to provide a worker pulling on the pull line with sufficient leverage to rotate the stanchion, and sufficiently short to allow the pull line to be grasped by such worker.

Still another subject of the invention is turning means for a stanchion operable by a worker positioned on a platform which is suspended from the stanchion, for use with a roof mounted stanchion of a type having a vertical portion, an upper horizontal portion, and means mounting the stanchion for rotation about an axis coinciding with its vertical portion, between an inboard position in which the horizontal portion of the stanchion projects inwardly over the roof and an outboard position in which the horizontal portion of the stanchion projects outwardly from the roof. According to an aspect of the invention, the turning means comprises a first support eye secured to an outer end part of the horizontal portion of the stanchion. A second support eye is secured to the horizontal portion of the stanchion at a location spaced inwardly of the first support eye. The turning means also includes an elongated turning lever insertable through the first support eye and then through the second support eye. Means are provided for securing the turning lever in position when the lever has been inserted in both of the support eyes and an outboard portion of the lever projects outwardly beyond the horizontal portion of the stanchion. A pull line is connected to the outer end of the turning lever. This pull line is of a length to be grasped by a worker positioned on the platform to enable the worker to use the line to pull on the horizontal portion of the stanchion from a position on the platform.

Preferably, the turning means further comprises a third support eye and a fourth support eye. The third support eye is secured to an outer end part of the horizontal portion of the stanchion and is spaced laterally from the first support eye. The fourth support eye is secured to the horizontal portion of the stanchion at a location spaced inwardly of the third support eye and laterally from the second support eye. The turning lever is insertable through said third support eye and then through said fourth support eye to enable a worker to adjust the position and angle of the lever with respect to said horizontal portion.

The method and apparatus of the present invention provide easy, quick, and safe means for moving a suspended platform into an outboard position ready to be lowered down the side of a structure. By use of the invention, the moving of a platform is accomplished while avoiding the additional expense of additional workers other than those stationed on the platform, and without any need for complex or expensive apparatus. The method and apparatus of the invention can be used with known platform and stanchion equipment, and the apparatus is inexpensive to manufacture, install, operate, and maintain.

These and other advantages and features will become apparent from the detailed description of the best mode for carrying out the invention that follows.

BRIEF DESCRIPTION OF THE DRAWINGS

In the drawings, like element designations refer to like parts throughout, and:

FIG. 1 is an elevational view of suspended platform apparatus incorporating the preferred embodiment of the invention, showing the platform in solid lines in a raised position over the roof of a structure and in phantom lines in a lowered position resting on such roof.

FIG. 2 is like FIG. 1 except that it shows the platform in a suspended outboard position.

FIGS. 3–7 are partially diagrammatic top plan views of the apparatus shown in FIGS. 1 and 2, illustrating the sequence of steps followed by two workers positioned on the platform to move the platform from the position shown in FIG. 1 to the position shown in FIG. 2.

BEST MODE FOR CARRYING OUT THE INVENTION

Figure 5:
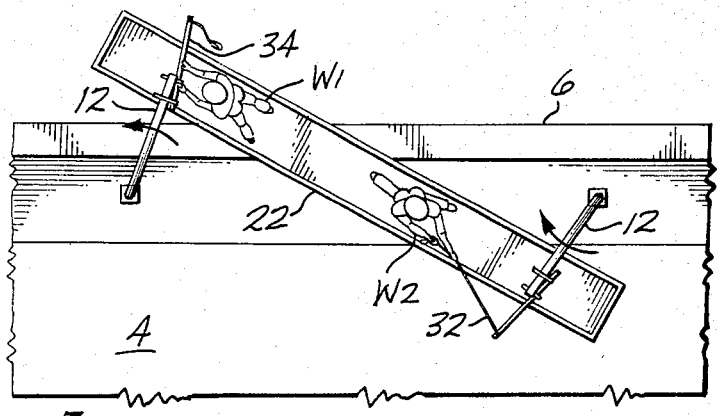

The drawings show apparatus that is constructed according to the invention and that also constitutes the best mode of the apparatus of the invention currently known to the applicant. The drawings also illustrate the best mode of the method of the invention currently known to the applicant. In the drawings, the method and apparatus of the invention are shown in use in conjunction with a structure 2 having a top or roof portion 4 with a side edge 6. The structure 2 is shown for the purpose of illustrating a typical use environment for the method and apparatus of the invention. It is of course to be understood that the details of the structure 2 may be varied considerably and that the method and apparatus of the invention may be used with a wide variety of structures without departing from the spirit and scope of the invention.

The apparatus shown in the drawings includes a pair of stanchions 12, each of which has a vertical portion 14 and an upper horizontal portion 16. Each stanchion 12 is mounted for rotation about an axis 18 that coincides with its vertical portion 14. The mounting apparatus 20 may take any of a number of suitable forms.

The structural details of the stanchions 12 may be varied a good deal without departing from the spirit and scope of the invention. The stanchions 12 shown in the drawings are one type of commonly used stanchion suitable for practicing the invention. The stanchions 12 are tubular in construction with an essentially constant circular cross section. The axes 18 coincide with the longitudinal axes of the vertical portions 14 of the stanchions 12.

The method and apparatus of the present invention may be used to move a number of different types of platforms into a suspended position outboard of a structure. The elongated platform 22 shown in the drawings is one type of platform that is typical of such types of platforms. Platform 22 is of the type disclosed in U.S. Pat. No. 3,994,036, granted Nov. 30, 1976, to Sidney L. Fisher and entitled "Flexible Staging Platform And The Like". The structure of the platform can most clearly be seen in FIG. 1 of that patent.

As shown in the drawings, the stanchions 12 are mounted at spaced apart locations on the roof 4 of the structure 2. The stanchions 12 rotate about their axes 18 between the inboard position shown in FIG. 1 in which the horizontal portions 16 project inwardly over the roof 4, and the outboard position shown in FIG. 2 in which the horizontal portions 16 project outwardly from the structure 2 over the side edge 6 of the roof 4. The distance between the locations of the two stanchions 12 is determined by the length of the platform 22. This distance is slightly less than the length of the platform 22 as can clearly be seen in FIG. 3. Thus, when the two stanchions 12 are in their inboard positions shown in FIG. 1 and the platform 22 is below the horizontal portions 16 of the stanchions 12, one end of the platform 22 is located under the horizontal portion 16 of one of the stanchions 12 and the other end of the platform 22 is located under the horizontal portion 16 of the other stanchion 12.

Each end of the platform 22 is connected to its corresponding stanchion 12 by a suspension system. Each such suspension system includes an upper end attached to the horizontal portion 16 of the stanchion 12 and a lower end attached to the corresponding end of the platform 22. The suspension systems serve to suspend the platform 22 from the stanchions 12 and also to permit the platform 22 to be moved upwardly or downwardly with respect to the horizontal portions 16 of the stanchions 12. Such movement is provided by a winch drum 24 around which is wound a cable 26. When the drum 24 is rotated in one direction, the platform 22 moves upwardly; and when the drum 24 is rotated in the opposite direction, the platform 22 moves downwardly. The winch drum 24 and cable 26 are known in the art and may take a variety of specific forms without departing from the spirit and scope of the invention. However, preferably the drum 24 is mounted on the platform 22, and a clevis 52 on the horizontal portion 16 provides means for engaging the cable 26.

The apparatus of the invention includes means for rotating or turning each stanchion 12 operable by a worker positioned on the platform 22. This rotating means includes a pull line 32 attached to the horizontal portion 16 of each stanchion 12. This pull line is operable by a worker located on the platform 22 adjacent to the stanchion 12 to pull on the horizontal portion 16 of the stanchion 12 while another worker positioned on the platform 22 adjacent to the other stanchion 12 is pushing on the horizontal portion 16 of the other stanchion 12.

The rotating means also includes an elongated turning lever 34 carried by each stanchion 12. Each lever 34 is attached to the horizontal portion 16 of its stanchion 12 and projects endwise outwardly beyond the outer end of such horizontal portion 16 a predetermined distance. One of the pull lines 32 is attached to the outer end of each of the levers 34. The predetermined distance by which each lever 34 projects beyond its stanchion 12 is chosen to be sufficiently great to provide a worker positioned on the platform 22 and pulling on the pull line 32 with sufficient leverage to rotate the stanchion 12, and sufficiently short to allow the pull line 32 to be easily grasped by such worker. The pull line 32 is preferably nearly twice as long as such predetermined distance to allow it to be pulled in the manner shown in FIGS. 3, 5, and 6. FIGS. 8-11 show the horizontal portion 16 of one of the stanchions 12 with its associated lever 34 and pull line 32. The upper end of the pull line 32 is looped to securely engage a ring 35 that is bolted onto the outer end of the lever 34. The lower end of pull line 32 is also looped to provide for easy grasping of the pull line 32.

The lever 34 is attached to the horizontal portion 16 by means of two sets of support eyes, including an outer set 36, 38 secured to an outer end part of the horizontal portion 16 and an inner set, each of which is designated by the reference numeral 44, secured to the horizontal portion 16 at a location spaced inwardly of the first set 36, 38. The elongated lever 34 is insertable through one of the eyes 36, 38 in the first set and then through one of the eyes 44, as shown in the drawings. In the preferred embodiment shown in the drawings, the first set of eyes includes two eyes 36, 38 formed by rings that are bolted to the outer end part of the horizontal portion 16. These eyes 36, 38 have basically the same form as the eye 35 to which the pull line 32 is attached.

In the preferred embodiment shown in the drawings, the second set of support eyes includes five eyes 44 formed by five holes extending through a semicircular support member 40. This support member 40 is secured to the horizontal portion 16 at a location spaced inwardly of the support eyes 36, 38. The support member 40 includes a radially extending flange 42 through which the holes 44 extend. The flange 42 extends from a circumferentially extending portion of member 40 that surrounds and conforms to the shape of approximately the lower half of the circumferential extent of horizontal portion 16. This circumferentially extending portion carries a lug 46 at each of its ends. A tie rod 48 engages the lugs 46 to clamp the support member 40 in place around the horizontal portion 16 of the stanchion 12. Each end of the tie rod 48 is bolted to one of the lugs 46.

The support eyes in each of the inner and outer sets are spaced laterally and circumferentially from each other. The positioning of the support eyes in both sets is designed to enable a worker to adjust the position and angle of the lever 34 with respect to the horizontal portion 16 of the stanchion 12. In order to adjust the angle and position, the worker need only remove the lever 34 from its initial position and reinsert the lever 34 into a different outer support eye and then a different inner support eye. This adjustment allows the worker to optimize the positioning of the lever 34 for turning the stanchion 12.

Once the lever 34 has been inserted through an outer and an inner support eye, the lever 34 is secured in position with its outboard portion projecting outwardly beyond the horizontal portion 16 of the stanchion 12. FIGS. 8-11 illustrate the preferred embodiment of the means for securing the lever 34 in place. Two tie lines 54 are secured to the clevis 52 which is located on the upper part of the horizontal portion 16 adjacent to its outer end. A lock pin 56 is attached to the outer end of each of the tie lines 54. Each lock pin 56 is of the type having one straight leg and one bent leg. The lock pins 56 engage the lever 34 to secure it in position. The straight leg of each lock pin 56 is inserted through a hole in the lever 34 provided for receiving the lock pin 56, as shown in the drawings. The lever 34 is positioned so that one lock pin 56 will be positioned on each side of the radial flange 42 of the support member 40. This arrangement serves to limit sliding movement of the lever 34 within the support eyes and has the advantages of simplicity and ease of operation.

FIGS. 3-7 illustrate the operation of the apparatus of the invention and the method of the invention.

The stanchions 12 are mounted on the roof 4 of the structure 2 as described above. Each stanchion 12 is moved into its inboard position shown in FIG. 1. The platform 22 is placed on the roof 4 under the horizontal portions 16 of the stanchions 12. Each end of the platform 22 is connected to its corresponding stanchion 12 by means of its suspension system. Two workers $W_1$, $W_2$ are positioned on the platform 22, one at each end of the platform 22. Once the platform 22 has been connected to the stanchions 12 and the workers $W_1$, $W_2$ have been positioned on the platform 22, the suspension systems are operated to rotate the winch drums 24 to raise the platform 22 up off of the roof. The platform 22 is then in a position (shown in solid lines in FIG. 1) from which it can moved into its outboard position shown in FIG. 2 by rotation of the stanchions 12.

The moving of the elevated platform 22 from the inboard position shown in FIG. 1 to the outboard position shown in FIG. 2 is accomplished in the following manner. The first worker $W_1$ pulls on the horizontal portion 16 of the first stanchion 12 while the second worker $W_2$ pushes on the horizontal portion 16 of the second stanchion 12, until the horizontal portion 16 of the first stanchion 12 is generally aligned with the platform 22. This step is illustrated in FIGS. 3 and 4. FIG. 3 shows the position of the platform 22 just after the first worker $W_1$ has begun to pull on the first stanchion 12. At this point, the first worker $W_1$ is pulling on the pull line 32. FIG. 4 shows the position of the platform 22 and stanchions 12 near the completion of the step when the lever 34 has moved to a position within the grasp of the first worker $W_1$ and worker $W_1$ is pulling directly on the lever 34.

When the stanchions 12 have been rotated an amount sufficient to bring the horizontal portion 16 of the first stanchion 12 into general alignment with the platform 22, worker $W_1$ begins to push on the horizontal portion 16 of the first stanchion 12 while worker $W_2$ begins to pull on the horizontal portion 16 of the second stanchion 12. Workers $W_1$, $W_2$ push and pull in this manner until the first end of the platform 22 is located outboardly of the structure 2 and the first stanchion 12 is generally in its outboard position. FIG. 5 illustrates worker $W_1$ pushing on the adjacent lever 34 and worker $W_2$ pulling on the adjacent pull line 32.

Figure 6:
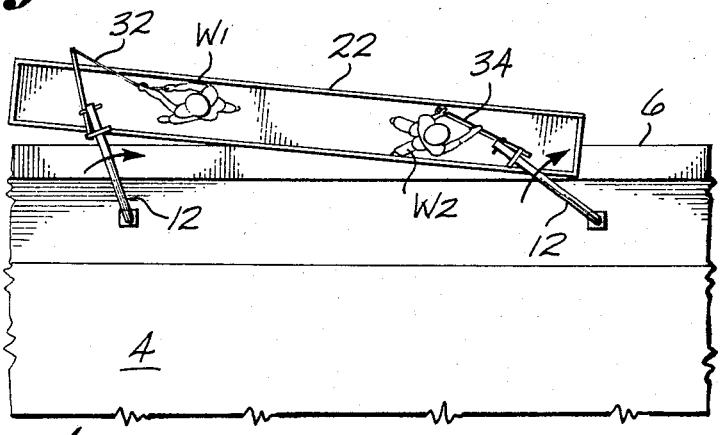

When the first end of the platform 22 is outboard of the structure 2 and the first stanchion 12 has rotated slightly beyond its outboard position, the first worker $W_1$ again pulls on the horizontal portion 16 of the first stanchion 12 while the second worker $W_2$ again pushes on the horizontal portion 16 of the second stanchion. This maneuver is illustrated in FIG. 6. Preferably, before beginning to pull and push, respectively, workers $W_1$, $W_2$ adjust the positions of the levers 34 from the position shown in FIGS. 3-5 to the positions shown in FIGS. 6 and 7. This adjustment facilitates the final pulling and pushing and places the levers in position for the commencement of the later procedure of moving the platform back into the inboard position shown in FIG. 1.

Figure 7:
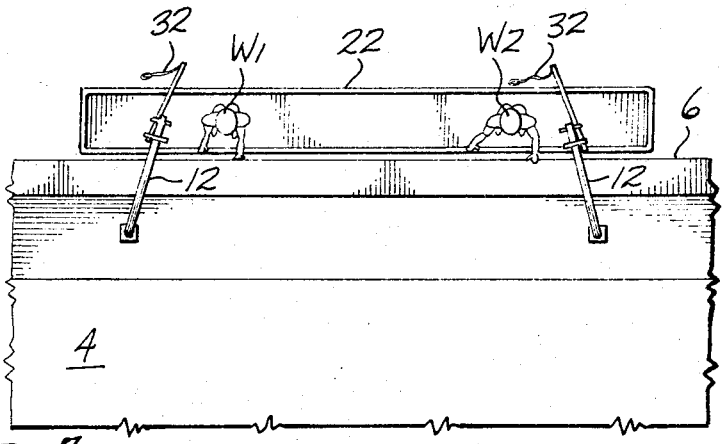
Figure 8:
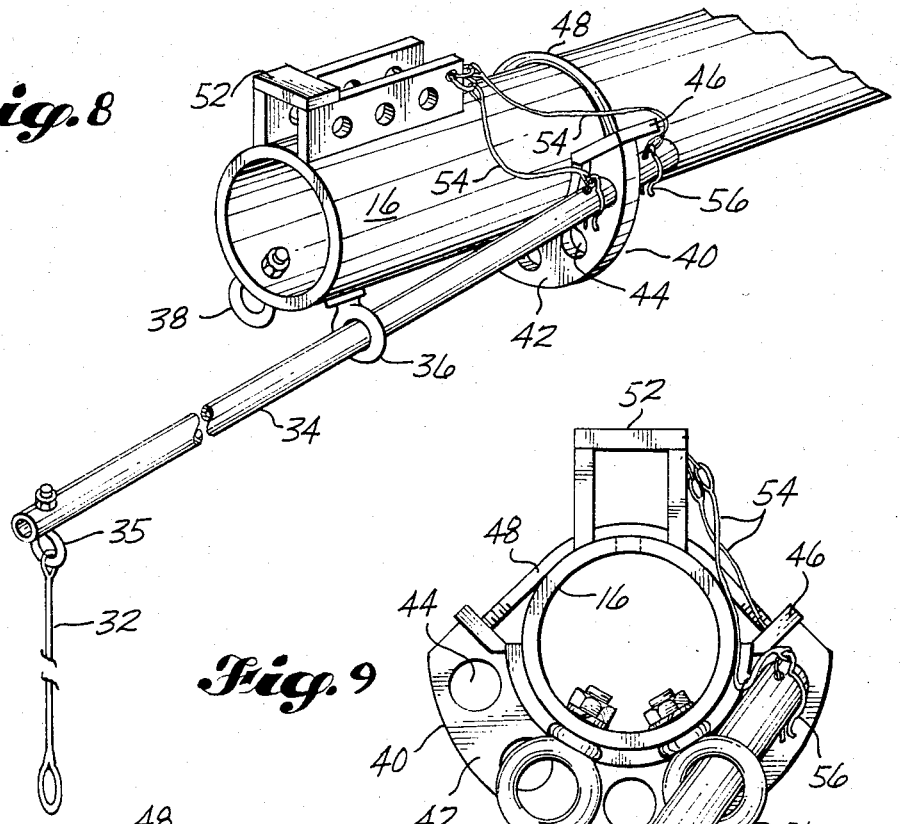
FIG. 8 is a pictorial view of the upper horizontal portion of the stanchion and the apparatus mounted thereon shown in FIGS. 1 and 2.
Figure 9:
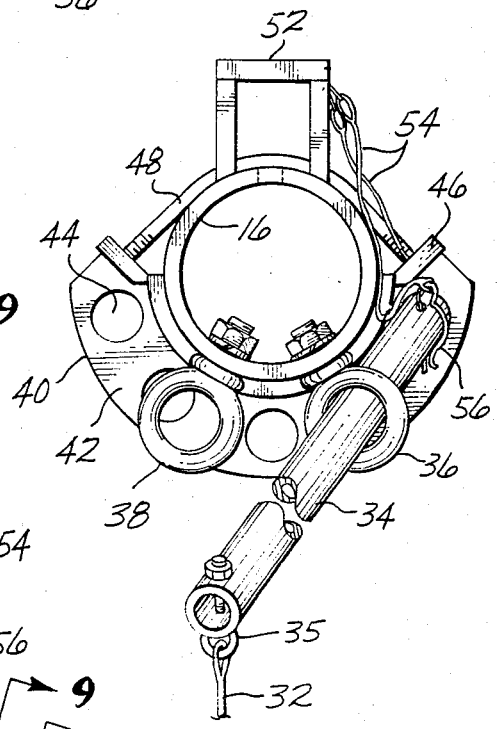
FIG. 9 is a front view of the apparatus shown in FIG. 8 taken along the line 9—9 in FIG. 11.
Figure 10:
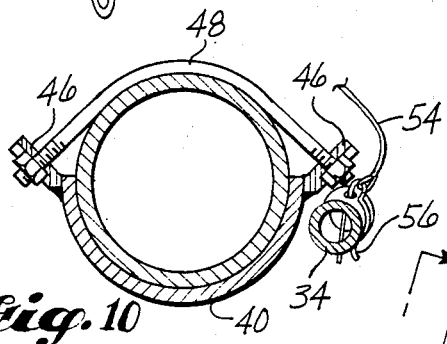
FIG. 10 is a sectional view taken along the line 10—10 in FIG. 11.
Figure 11:
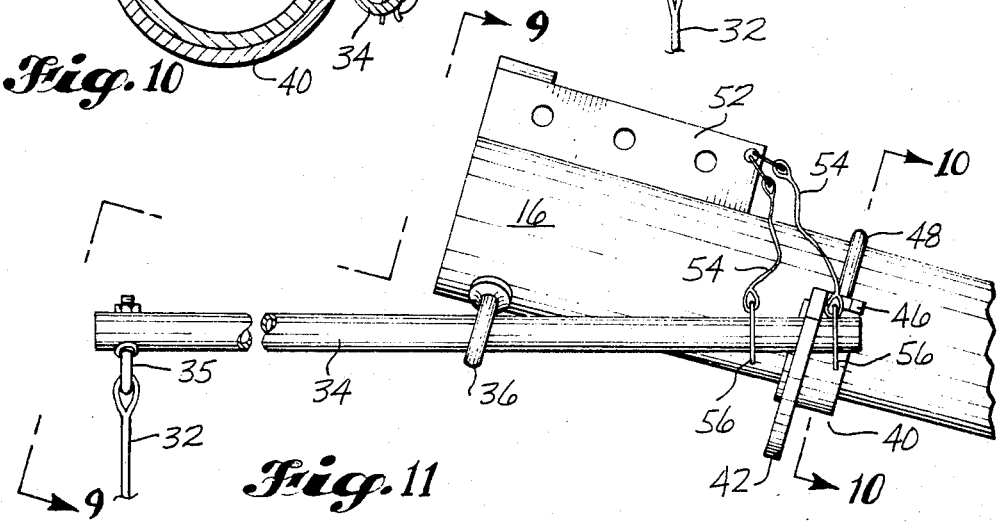
FIG. 11 is a side elevational view of the apparatus shown in FIG. 8.

Workers $W_1$, $W_2$ continue their respective pulling and pushing until the stanchions 12 are both in their outboard positions and the platform 22 is in an outboard position generally parallel to the face of the structure 2. The winches 24 are then operated to lower the platform 22 a short distance as indicated in phantom lines in FIG. 2. With the platform 22 in the lowered position, the workers make final adjustments in the positioning of the platform 22 by pushing on the side of the structure 2 as illustrated in FIG. 7.

It will be obvious to those skilled in the art to which this invention is addressed that the invention may be used to advantage in a variety of situations. Therefore, it is also to be understood by those skilled in the art that various changes, modifications, and omissions in form and detail may be made without departing from the spirit and scope of the present invention as defined by the following claims.

What is claimed is:

1. A method of moving a platform from a position on a roof of a structure to a suspended position outboard of the structure, comprising:

providing a pair of stanchions, each of a type having a vertical portion and an upper horizontal portion;

providing the horizontal portion of each stanchion with handhold means that is carried by and rotates with its corresponding horizontal portion;

mounting the stanchions at spaced apart locations on the roof of the structure, for rotation about axes coinciding with said vertical portions, between an inboard position in which the horizontal portions of the stanchions project inwardly over the roof of the structure and an outboard position in which the horizontal portions of the stanchions project outwardly from the structure;

positioning an elongated platform on the roof of the structure, with each stanchion in its inboard position, with a first end of the platform located under the horizontal portion of a first one of the stanchions, and with the second end of the platform located under the horizontal portion of the second stanchion;

connecting the first end of the platform to the first stanchion by a first suspension system including an upper end attached to the horizontal portion of the first stanchion and a lower end attached to the platform, and connecting the second end of the platform to the second stanchion by a second suspension system including an upper end attached to the horizontal portion of the second stanchion and a lower end attached to the platform, each said system including a winch drum which when rotated in one direction causes the platform to move upwardly and when rotated in the opposite direction causes the platform to move downwardly;

locating two workers on the platform, one at each end of the platform;

operating the suspension system for raising the platform up off of the roof, into a position from which the platform can be moved into its outboard position by a rotation of the stanchions; and moving the elevated platform into its outboard position, in the following manner:

one of the workers pulls on the handhold means of the horizontal portion of the first stanchion while the second worker pushes on the handhold means of the horizontal portion of the second stanchion, until the horizontal portion of the first stanchion is generally aligned with the platform;

then the first worker pushes on said means of the horizontal portion of the first stanchion while the second worker pulls on said means of the horizontal portion of the second stanchion, until the first end of the platform is located outboardly of the structure and the first stanchion is generally in its outboard position; and then the first worker again pulls on said means of the horizontal portion of the first stanchion while the second worker again pushes on said means of the horizontal portion of the second stanchion, until the stanchions are in their outboard positions and the platform is in an outboard position generally parallel to the face of the structure.

2. The method of claim 1, wherein providing the horizontal portion of each stanchion with handhold means comprises providing such horizontal portion with a pull line, and wherein the workers use the pull lines at least part of the time when pulling on the stanchions.

3. A method according to claim 2, wherein providing said handhold means further comprises providing each stanchion with a lever which projects endwise outwardly from the horizontal portion of the stanchion, and securing the pull line to the outer end of the lever.

4. Suspended platform apparatus, comprising:

a pair of stanchions, each of a type having a vertical portion and an upper horizontal portion;

means for mounting the stanchions at spaced apart locations on a roof of a structure, for rotation about axes coinciding with said vertical portions, between an inboard position in which the horizontal portions of the stanchions project inwardly over the roof of the structure and an outboard position in which the horizontal portions of the stanchions project outwardly from the structure;

an elongated platform having a first end and a second end, said platform being of such a length that when the two stanchions are in their inboard positions and the platform is on the roof below the horizontal portions of the two stanchions, the first end of the platform is located under the horizontal portion of a first one of the stanchions and the second end of the platform is located under the horizontal portion of the second stanchion;

a first suspension system connecting the first end of the platform to the first stanchion, said system including an upper end attached to the horizontal portion of the first stanchion and a lower end attached to the first end of the platform, and said system including a winch drum which when rotated in one direction causes the platform to move upwardly and when rotated in the opposite direction causes the platform to move downwardly;

a second suspension system connecting the second end of the platform to the second stanchion, said second system including an upper end attached to the horizontal portion of the second stanchion and a lower end attached to the second end of the platform, and said second system including a winch drum which when rotated in one direction causes the platform to move upwardly and when rotated in the opposite direction causes the platform to move downwardly; and means for rotating the stanchions by two workers located on the platform, one adjacent to each stanchion; said means for rotating including handhold means carried by the horizontal portion of each stanchion for rotation therewith; and each such handhold means including a pull line attached to the horizontal portion of the corresponding stanchion, operable by a worker who is positioned adjacent to such stanchion to pull on the horizontal portion of such stanchion while the other worker is pushing on the horizontal portion of the other stanchion.

5. The apparatus of claim 4, wherein each handhold means further includes a lever carried by the corresponding stanchion, said lever being attached to the horizontal portion of such stanchion and projecting endwise outwardly beyond the outer end of the horizontal portion of such stanchion a predetermined distance, and wherein the pull lines are attached to the outer ends of the levers; said distance being sufficiently great to provide a worker pulling on the pull line with sufficient leverage to rotate the stanchion, and sufficiently short to allow the pull line to be grasped by such worker.

6. For use with a roof mounted stanchion of a type having a vertical portion, an upper horizontal portion, and means mounting said stanchion for rotation about an axis coinciding with its vertical portion, between an inboard position in which the horizontal portion of the stanchion projects inwardly over the roof and an outboard position in which the horizontal portion of the stanchion projects outwardly from the roof, turning means for the stanchion operable by a worker positioned on a platform which is suspended from the stanchion, comprising:

a first support eye secured to an outer end part of the horizontal portion of the stanchion;

a second support eye secured to the horizontal portion of the stanchion at a location spaced inwardly of the first support eye;

an elongated turning lever insertable through said first support eye and then through said second support eye;

means for securing the turning lever in position when the lever has been inserted in both of the support eyes and an outboard portion of the lever projects outwardly beyond the horizontal portion of the stanchion; and a pull line connected to the outer end of the turning lever, said pull line being of a length to be grasped by a worker positioned on the platform to enable the worker to use the line to pull on the horizontal portion of the stanchion from a position on the platform.

7. Turning means as described in claim 6, which further comprises a third support eye secured to an outer end part of the horizontal portion of the stanchion and spaced laterally from the first support eye, and a fourth support eye secured to the horizontal portion of the stanchion at a location spaced inwardly of the third support eye and laterally from the second support eye; and in which the turning lever is insertable through said third support eye and then through said fourth support eye to enable a worker to adjust the position and angle of the lever with respect to said horizontal portion.

8. A method of moving a platform from a position on a roof of a structure to a suspended position outboard of the structure, comprising:

providing a pair of stanchions, each of a type having a vertical portion and an upper horizontal portion;

providing the horizontal portion of each stanchion with a pull line, providing each stanchion with a lever which projects endwise outwardly from the horizontal portion of the stanchion, and securing the pull line to the outer end of the lever;

mounting the stanchions at spaced apart locations on the roof of the structure, for rotation about axes coinciding with said vertical portions, between an inboard position in which the horizontal portions of the stanchions project inwardly over the roof of the structure and an outboard position in which the horizontal portions of the stanchions project outwardly from the structure;

positioning an elongated platform on the roof of the structure, with each stanchion in its inboard position, with a first end of the platform located under the horizontal portion of a first one of the stanchions, and with the second end of the platform located under the horizontal portion of the second stanchion;

connecting the first end of the platform to the first stanchion by a first suspension system including an upper end attached to the horizontal portion of the first stanchion and a lower end attached to the platform, and connecting the second end of the platform to the second stanchion by a second suspension system including an upper end attached to the horizontal portion of the second stanchion and a lower end attached to the platform, each said system including a winch drum which when rotated in one direction causes the platform to move upwardly and when rotated in the opposite direction causes the platform to move downwardly;

locating two workers on the platform, one at each end of the platform;

operating the suspension system for raising the platform up off of the roof, into a position from which the platform can be moved into its outboard position by a rotation of the stanchions; and moving the elevated platform into its outboard position, in the following manner:

one of the workers pulls on the horizontal portion of the first stanchion while the second worker pushes on the horizontal portion of the second stanchion, until the horizontal portion of the first stanchion is generally aligned with the platform;

then the first worker pushes on the horizontal portion of the first stanchion while the second worker pulls on the horizontal portion of the second stanchion, until the first end of the platform is located outboardly of the structure and the first stanchion is generally in its outboard position; and then the first worker again pulls on the horizontal portion of the first stanchion while the second worker again pushes on the horizontal portion of the second stanchion, until the stanchions are in their outboard positions and the platform is in an outboard position generally parallel to the face of the structure;

wherein the workers use the pull lines at least part of the time when pulling on the stanchions.

9. Suspended platform apparatus, comprising:

a pair of stanchions, each of a type having a vertical portion and an upper horizontal portion;

means for mounting the stanchions at spaced apart locations on a roof of a structure, for rotation about axes coinciding with said vertical portions, between an inboard position in which the horizontal portions of the stanchions project inwardly over the roof of the structure and an outboard position in which the horizontal portions of the stanchions project outwardly from the structure;

an elongated platform having a first end and a second end, said platform being of such a length taht when the two stanchions are in their inboard positions and the platform is on the roof below the horizontal portions of the two stanchions, the first end of the platform is located under the horizontal portion of a first one of the stanchions and the second end of the platform is located under the horizontal portion of the second stanchion;

a first suspension system connecting the first end of the platform to the first stanchion, said system including an upper end attached to the horizontal portion of the first stanchion and a lower end attached to the first end of the platform, and said system including a winch drum which when rotated in one direction causes the platform to move upwardly and when rotated in the opposite direction causes the platform to move downwardly;

a second suspension system connecting the second end of the platform to the second stanchion, said second system including an upper end attached to the horizontal portion of the second stanchion and a lower end attached to the second end of the platform, and said second system including a winch drum which when rotated in one direction causes the platform to move upwardly and when rotated in the opposite direction causes the platform to move downwardly;

means for rotating the stanchions by two workers located on the platform, one adjacent to each stanchion, said means for rotating including a pull line attached to the horizontal portion of each stanchion, operable by a worker who is positioned adjacent to such stanchion to pull on the horizontal portion of such stanchion while the other worker is pushing on the horizontal portion of the other stanchion; and a lever carried by each stanchion, each such lever being attached to the horizontal portion of the stanchion and projecting endwise outwardly beyond the outer end of the horizontal portion of the stanchion a predetermined distance, said pull lines being attached to the outer ends of the levers, and said distance being sufficiently great to provide a worker pulling on the pull line with sufficient leverage to rotate the stanchion, and sufficiently short to allow the pull line to be grasped by such worker.

* * * * *

UNITED STATES PATENT AND TRADEMARK OFFICE

CERTIFICATE OF CORRECTION

PATENT NO. : 4,538,705

DATED : September 3, 1985

INVENTOR(S) : Ole E. Leivestad

It is certified that error appears in the above-identified patent and that said Letters Patent are hereby corrected as shown below:

Column 1, line 37, "screw" should be -- crew --.

Column 8, line 25, "position" should be -- positions --.

Column 12, line 37, "taht" should be -- that --.

Signed and Sealed this

*Seventeenth* Day of *June 1986*

[SEAL]

*Attest:*

DONALD J. QUIGG

*Attesting Officer*

*Commissioner of Patents and Trademarks*